US007963277B2

(12) United States Patent
Gates et al.

(10) Patent No.: US 7,963,277 B2
(45) Date of Patent: Jun. 21, 2011

(54) EXHAUST GAS RECIRCULATION CONTROL SYSTEM

(75) Inventors: Freeman Carter Gates, Bloomfield Hills, MI (US); Gitanjli McRoy, Ann Arbor, MI (US); Sassan Farahmand, Canton, MI (US); Joseph Michael Grandas, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 370 days.

(21) Appl. No.: 12/147,037

(22) Filed: Jun. 26, 2008

(65) Prior Publication Data

US 2009/0320811 A1 Dec. 31, 2009

(51) Int. Cl.
*F02M 25/07* (2006.01)

(52) U.S. Cl. ..... 123/568.29; 123/568.21

(58) Field of Classification Search ..... 123/568.29, 123/568.25, 568.21
See application file for complete search history.

(56) References Cited

U.S. PATENT DOCUMENTS

| | | | | |
|---|---|---|---|---|
| 4,173,205 A | | 11/1979 | Toelle | |
| 4,185,607 A | | 1/1980 | Thornburgh | |
| 4,242,997 A | * | 1/1981 | Kohama et al. | 123/568.29 |
| 5,027,781 A | | 7/1991 | Lewis | |
| 5,203,313 A | * | 4/1993 | Rotarius | 123/568.27 |
| 5,241,940 A | * | 9/1993 | Gates, Jr. | 123/568.27 |
| 5,613,479 A | * | 3/1997 | Gates et al. | 123/568.27 |
| 6,014,961 A | * | 1/2000 | Gates | 123/568.21 |
| 7,278,410 B2 | * | 10/2007 | Hoke et al. | 123/568.11 |
| 2008/0308080 A1 | * | 12/2008 | Gates | 123/568.21 |

FOREIGN PATENT DOCUMENTS

| | | |
|---|---|---|
| JP | 58-091356 A | 5/1983 |
| JP | 58-106277 A | 6/1983 |
| JP | 08-247329 A | 9/1996 |

* cited by examiner

*Primary Examiner* — Stephen K Cronin
*Assistant Examiner* — Arnold Castro
(74) *Attorney, Agent, or Firm* — Julia Voutyras; Brooks Kushman P.C.

(57) ABSTRACT

An exhaust gas recirculation system has an EGR valve disposed in an EGR duct connecting an engine intake and exhaust. A diaphragm of said EGR valve is actuated via vacuum from the engine intake, the application of the vacuum is controlled via an electronic valve regulator (EVR). The EVR is provided a fixed signal to cause it to be fully open when it is determined that the engine is about to encounter a condition in which there is insufficient vacuum to open the EGR valve. The EVR is provided a variable signal during other operating conditions in which there is sufficient vacuum to open the EGR valve.

20 Claims, 3 Drawing Sheets

Figure 1:
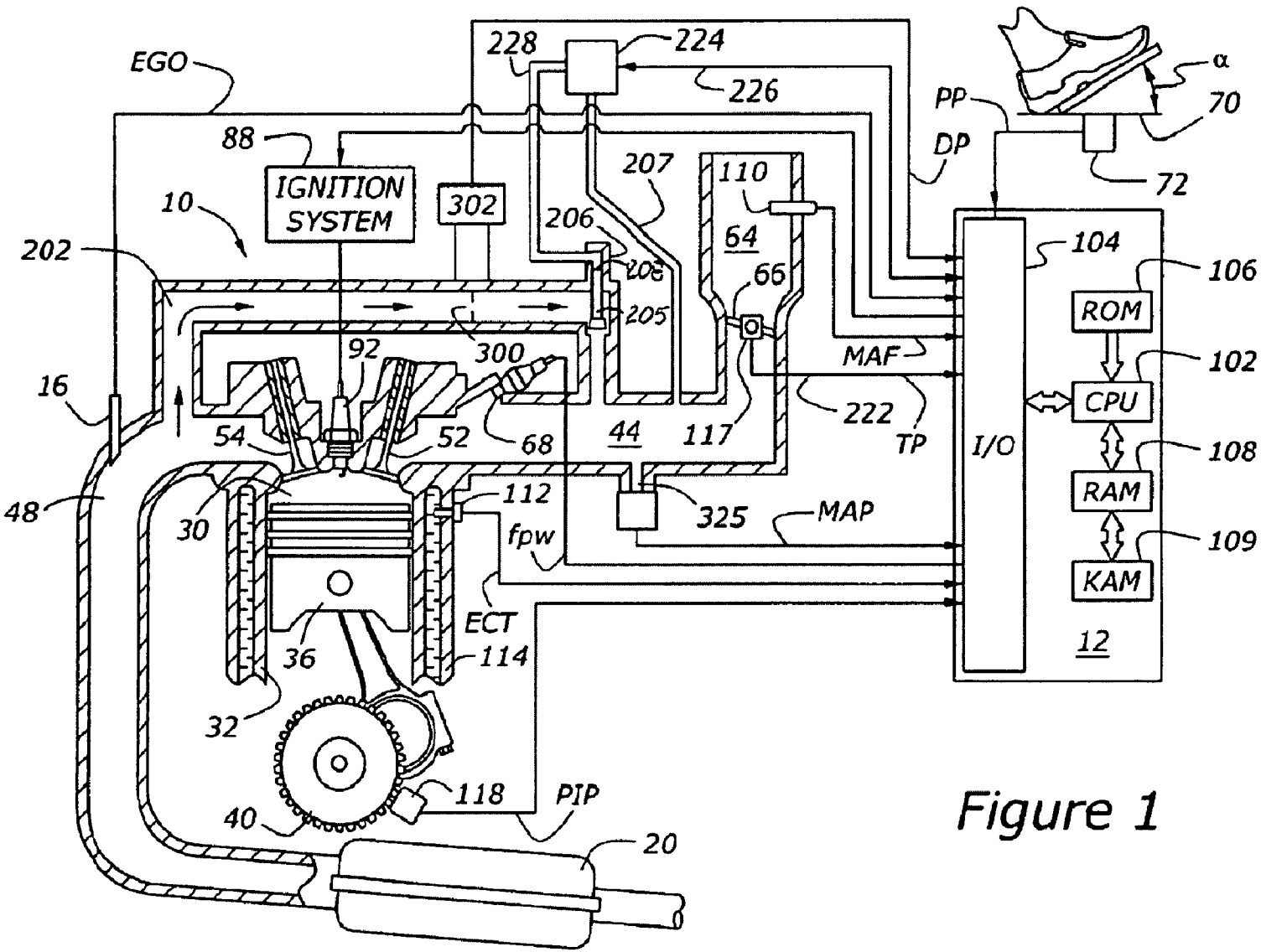

0% duty cycle
DC input

100% duty cycle
DC input

EXHAUST GAS RECIRCULATION CONTROL SYSTEM

TECHNICAL FIELD

This invention relates generally to internal combustion engines and more particularly to internal combustion engines having exhaust gas recirculation (EGR) systems.

BACKGROUND OF THE INVENTION

As is known in the art, new 5-cycle EPA fuel economy tests are designed to replicate real world customer driving patterns. The new highway FE (fuel economy) label will be influenced greatly by US06 level testing (80%). During these tests, the acceleration rates are greater than or equal to 15 mph/sec. The existing FTP (Federal Test Procedure) requirements are approximately 3 mph/sec. Under these rapid acceleration conditions, the inventors have recognized that with some vehicles the vacuum in the intake is insufficient to open the EGR valve since the throttle is at or near wide open throttle conditions.

SUMMARY OF THE INVENTION

In accordance with the present invention, an EGR system for an internal combustion engine is provided. The system includes an EGR valve for controlling exhaust gas flow between an exhaust manifold of the engine and an intake manifold of the engine and an EGR control system for producing a control signal for the EGR valve. Whether vacuum is applied to the EGR valve to cause it to open or remain in a closed state is controlled by the electronic valve regulator (EVR) which is in fluid communication with the intake manifold and the EGR valve. The EVR has a solenoid valve which can be pulse width modulated. When the solenoid of the EVR causes the EVR to open, vacuum is applied to the EGR valve. When the EVR is closed, the EGR valve remains closed because no vacuum is applied to open it.

According to the present invention, EVR control is based on an indication of whether the engine will soon encounter a condition with insufficient vacuum in the engine intake to operate the EGR valve. The indication is based on one or more of: manifold absolute pressure (MAP), torque, pedal position, throttle position, engine speed, crankshaft acceleration, and the time rate of change of any of those parameters.

A method for controlling an EGR valve coupled to an internal combustion engine is disclosed in which a fixed control signal is provided to the EGR valve in response to an indication that the engine will soon encounter a condition with insufficient vacuum in the engine intake to operate the EGR valve. Further, a variable control signal is provided to the EGR valve in accordance with engine operating parameters in response to an indication that the engine has sufficient vacuum in the engine intake to operate the EGR valve. The fixed control signal commands the EVR to open as fully as possible thus communicating intake vacuum to the EGR valve. The vacuum required to open the EGR valve depends on the EGR valve design, but is in the range of 3 to 6 inches Hg. The indication that the engine will soon encounter a condition with insufficient vacuum is based on at least one of: a signal from an accelerator pedal position sensor, a signal from an absolute pressure sensor disposed in the engine intake, and throttle position.

In one embodiment, an exhaust gas recirculation system for an internal combustion engine is provided. The system includes: an EGR valve; an EVR coupled to the EGR valve; a pressure sensor for sensing differential pressure across an orifice disposed between an exhaust manifold of the engine and the EGR value; an EGR control system for producing either: an error signal related to the difference between a desired differential pressure across the orifice and an actual differential pressure across the orifice, such error signal producing a variable control signal for the actuator when the rate of change in throttle position is less than a predetermined value; or a fixed control signal for the actuator having a fixed value independent of the error signal when the rate of change in throttle position is greater than the predetermined value to maximize EGR flow though the EGR valve.

With such a system, when there is barely sufficient vacuum and a change is indicate is indicated by a change in throttle position, manifold absolute pressure (MAP), or torque, the controller commands a 100% duty cycle (i.e., the fixed control signal) to the electronic valve regulator. This action results in trapping vacuum onto a diaphragm of the EGR valve. This trapped vacuum allows the delivery of maximum EGR during rapid acceleration when manifold vacuum approaches atmospheric pressure.

The details of one or more embodiments of the invention are set forth in the accompanying drawings and the description below. Other features, objects, and advantages of the invention will be apparent from the description and drawings, and from the claims.

BRIEF DESCRIPTION ON THE FIGURES

Figure 2A:
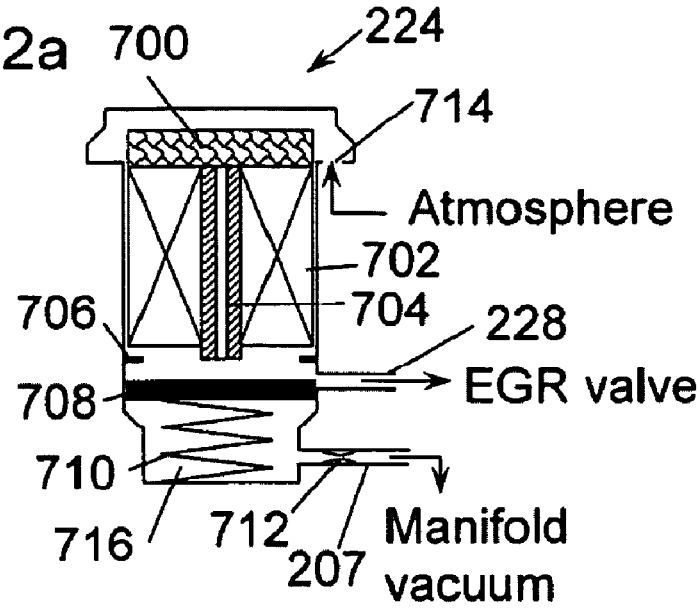
Figure 2B:
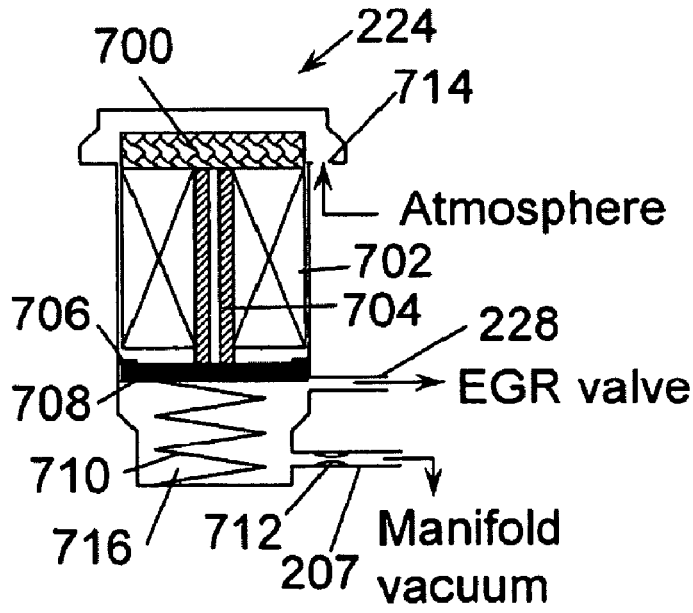
Figure 3:
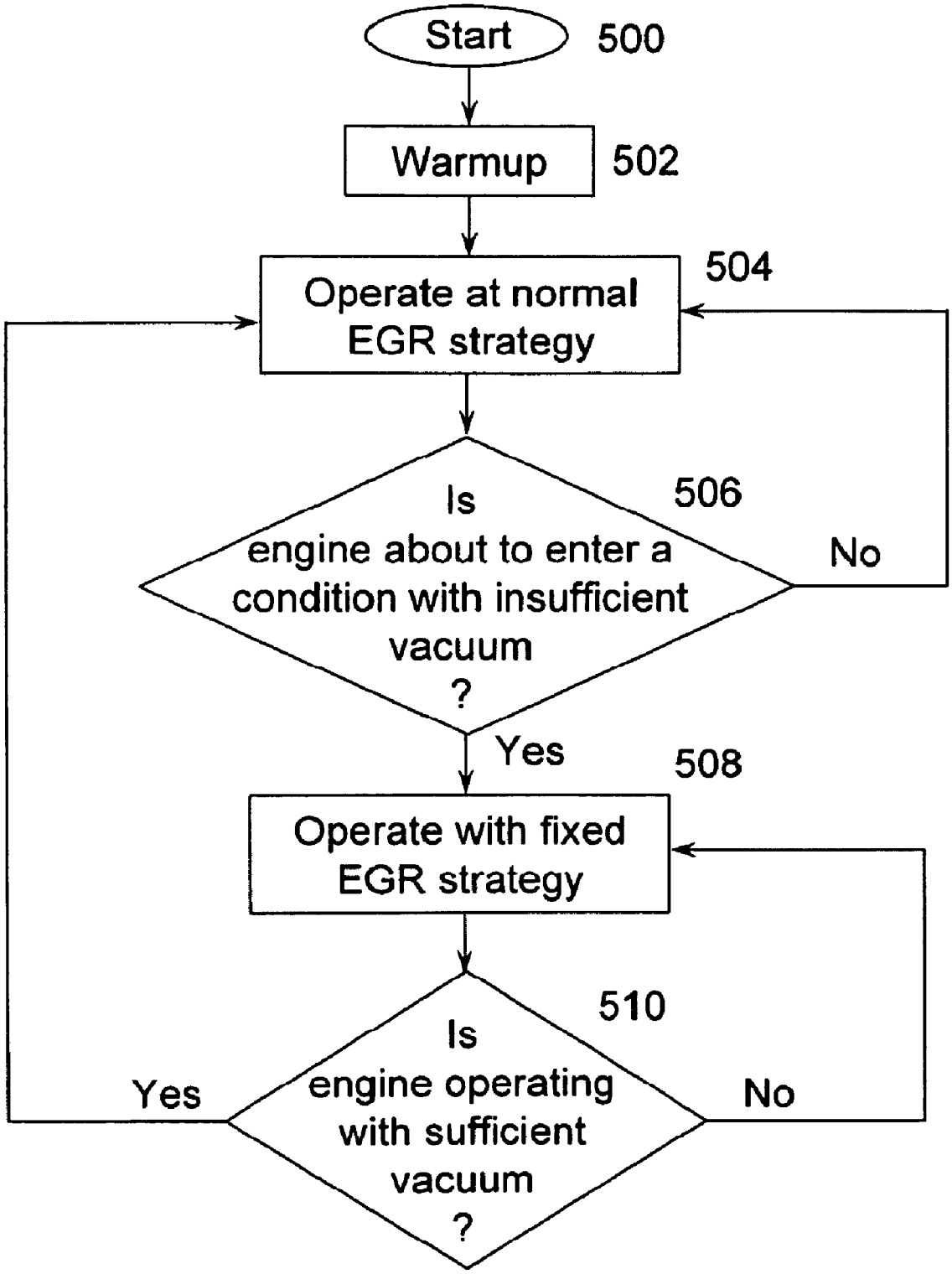

FIG. 1 is a diagram of an internal combustion engines having an EGR system according to the invention;

FIG. 2*a-b* show in detail the electronic valve regulator (EVR) with a 0% duty cycle and 100% duty cycle applied to the coil; and FIG. 3 is a flow chart of the process used by the EGR control system in FIG. 1.

Like reference symbols in the various drawings indicate like elements.

DETAILED DESCRIPTION

Referring now to FIG. 1, an internal combustion engine 10 is shown comprising a plurality of cylinders, one cylinder of which is shown in FIG. 1, controlled by electronic control unit 12. Engine 10 includes combustion chamber 30 and cylinder walls 32 with piston 36 positioned therein and connected to crankshaft 40. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20.

Intake manifold 44 communicates with throttle body 64 via throttle plate 66. Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown). Engine 10 further includes a conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, read only memory (ROM) 106, random access memory (RAM) 108, and a conventional data bus. The controller 12 may also include keep alive memory (KAM) 109.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of manifold pressure (MAP) from manifold pressure sensor 116 coupled to intake manifold 44; a measurement of throttle position (TP) from throttle position sensor 117 coupled to throttle plate 66; a measure of pedal position from pedal position sensor 72 coupled to accelerator pedal 70; and a profile ignition pickup signal (PIP) from Hall effect sensor 118 coupled to crankshaft 40.

Intake manifold 44 communicates with exhaust gas recirculation (EGR) valve 206. Exhaust gas is delivered from exhaust manifold 48 to intake manifold 44 by a conventional EGR tube 202 communicating with EGR valve 206. EGR valve 206 has a piston 205 which is held in a closed position by a spring (not shown) unless there is sufficient vacuum communicated to a diaphragm 208 to cause piston 205 to move against the spring force allowing piston 205 to rise off its seat allowing flow of exhaust gases from EGR line 202 into engine intake 44. Control of the vacuum acting on diaphragm 208 is controlled by an electronic valve regulator (EVR) 224. EVR 224 is coupled to EGR valve 206 through a tube 228. EVR 224 receives vacuum from the intake manifold 44 through tube 207. EVR 224 receives an actuation signal 226 from controller 12. When provided a 100% duty cycle, EVR 224 opens and allows intake vacuum to be applied to diaphragm 208 of EGR valve 206. At a lesser duty cycle, EVR 224 attains a position between fully open and fully closed and less than full vacuum is applied to EGR valve 206.

A control orifice 300 is disposed in tube 202, as shown. The differential pressure across orifice 300 is sensed by a differential pressure sensor 302. The differential pressure signal DP is fed to controller 12, as shown.

Barometric pressure is detected by MAP sensor 116 at key on, i.e., before the engine has developed a vacuum in the intake manifold and can be updated during operation when wide open throttle operation has been achieved. Alternatively, a barometric pressure sensor (not shown), coupled to controller 12, is employed.

The signal on line 226 is a pulse width modulated signal with a duty cycle varied in accordance with the error signal (difference between desired pressure drop and actual pressure drop). A 100% duty cycle causes EVR 224 to be open and apply as much vacuum as is available in the manifold onto diaphragm 208 of EGR valve 206. However, EGR valve 206 cannot open without sufficient vacuum. When such an operating condition is about to be encountered, i.e., insufficient vacuum to actuate EGR valve 206, control switches from normal EGR control, varying in response to engine operating conditions, to fixed control. As described above according to one embodiment, EVR 224 is controlled by imposing a duty cycle. Fixed control corresponds to commanding 100% duty cycle. The EGR valve described herein is not intended to be limiting. Other types of EGR valve control are compatible with the present invention.

A sufficient vacuum is that which allows EGR valve actuation. Depending on the EGR valve design, a sufficient vacuum is in the range of 3 to 6 inches Hg. The vacuum is defined as a difference in pressure between intake 44 and barometric pressure.

The closed loop system that modulates a pneumatically-controlled EGR valve, according to one embodiment, is controlled so as to achieve a desired flow. This system infers actual flow based on a measure of the differential pressure drop across orifice 300 located in the EGR flow stream.

In an alternative embodiment, the desired flow can be achieved by mapping the opening position of EGR valve 206 valve to EGR flow. Closed loop control is based on a position sensor (typically potentiometric) mounted directly on top of the EGR valve 206 providing a proportional resistance (or voltage) as an indicator of EGR valve position. Based on upstream (exhaust) pressure and downstream pressure (MAP) and EGR temperature EGR flow is computed. The error signal is the difference between the desired valve position (voltage) and the actual EVP (EGR valve position) sensor voltage. This error is fed into a PI or PID controller to achieve the desired EGR valve position.

A variety of engine operating parameters are suitable to indicate that an engine operating condition with insufficient vacuum is soon to be encountered by engine 10: throttle position, time rate of change of throttle position, pedal position, time rate of pedal position, MAP, a time rate of change of MAP, normalized engine torque (actual torque divided by maximum torque at the particular rpm), and rate of change of normalized engine torque.

In FIGS. 2*a* and *b*, EVR 224 is shown in more detail. EVR 224 has a port 714 communicating with atmospheric air which relieves the vacuum in the EGR valve system depending on the position of disk 708. Any air inducted through port 714 passes through a mechanical filter 700 to remove debris and passes through hollow stator 704. FIG. 2*a* shows EVR 224 when no DC is input to coil 702. Disk 708 is in a neutral position, as determined by spring 710, because stator 704 is not applying an attractive force to disk 708. Port 228 communicating with the EGR valve 206 communicates with atmospheric pressure.

In FIG. 2*b*, 100% duty cycle DC input is applied to coil 702. Stator 704 attracts disk 228. Disk 228 raises until it meets with stop 706, which is a ring that seals against disk 228. When disk 708 is sealed against stop 706, port 228 is sealed off from atmospheric pressure. Manifold vacuum is trapped within the lower portion 716 of EVR 224. That vacuum is communicated to EGR valve 206 through port 288. Because stop 706 seals disk 708 from atmospheric pressure, the vacuum in 710 that is communicated to EGR 206 valve is maintained for a long period of time and actuates the EGR valve to stay open. Within port 207 which connects to the intake manifold, there is a restrictor. In one non-limiting embodiment, the diameter of the restrictor is about 0.3 mm.

In FIG. 3, the engine is started in 500 and is warmed up in 502. After warmup, the normal EGR strategy is employed in 504. A check is performed periodically in 506. If the engine continues to operate without encountering insufficient vacuum to operate the EGR valve, control passes back to 504. When insufficient vacuum is encountered in 506, control passes to 508 in which the fixed (command to fully open) EGR strategy is employed. A check is performed periodically in 510. If the engine falls back into a condition with sufficient vacuum, control returns to 504; otherwise, control returns to 508.

A number of embodiments of the invention have been described. Nevertheless, it will be understood that various modifications may be made without departing from the spirit and scope of the invention. Accordingly, other embodiments are within the scope of the following claims.

We claim:

1. An exhaust gas recirculation (EGR) system for an internal combustion engine, comprising:

an EGR valve for controlling exhaust gas flow between an exhaust manifold of the engine and an intake manifold of the engine;

an electronic valve regulator (EVR) coupled between said intake manifold and said EGR valve, an open and closed state of said EVR being electrically controlled;

an electronic control unit coupled to said EVR and the engine, said electronic control unit providing a control signal to said EVR based on an indication of whether the engine is about to encounter a condition with insufficient vacuum to operate said EGR valve.

2. The EGR system of claim 1 wherein said control signal is a variable control signal based on engine operating parameters when the engine is not about to encounter such condition.

3. The EGR system of claim 1 wherein said control signal is a fixed control signal when the engine is about to encounter such condition.

4. The EGR system of claim 3 wherein said fixed control signal causes said EVR to be substantially wide open.

5. The EGR system of claim 1 wherein said indication is based on a rate of change in throttle position, said throttle, being disposed in an engine intake, controls air flow to the engine.

6. The EGR system of claim 1, further comprising: an operator-actuated accelerator pedal having a pedal position sensor, such sensor being electronically coupled to said electronic control unit, wherein said indication is based on a rate of change in pedal position.

7. The EGR system of claim 1 wherein said indication is based on pressure in the intake manifold.

8. A method for controlling an EGR valve coupled to an internal combustion engine, the EGR valve being disposed in a duct connecting an engine intake and an engine exhaust, wherein a diaphragm of the EGR valve is coupled to the engine intake via an electronic valve regulator (EVR), comprising: providing a fixed control signal to fully open said EVR in response to an indication that the engine will soon encounter a condition with insufficient vacuum in the engine intake to operate the EGR valve.

9. The method of claim 8, further comprising: providing a variable control signal to the EGR valve in accordance with engine operating parameters in response to an indication that the engine has sufficient vacuum in the engine intake to operate the EGR valve.

10. The method of claim 9, further comprising: generating an error signal related to the difference between a desired differential pressure across the orifice and an actual differential pressure across the orifice, such error signal providing said variable control signal to said EVR.

11. The method of claim 8 wherein insufficient vacuum is less than about 3 inches of Hg, said vacuum being between the engine intake and barometric pressure.

12. The method of claim 8 wherein said indication is based on at least one of:

a signal from an accelerator pedal position sensor, said accelerator pedal position sensor and said engine being disposed in a vehicle;

a signal from an absolute pressure sensor disposed in the engine intake; and throttle position, said throttle being disposed in the engine intake, the position of said throttle controlling intake flow into the engine.

13. A method for controlling an EGR valve coupled to an internal combustion engine, the EGR valve being disposed in a duct connecting an engine intake and an engine exhaust, wherein a diaphragm of the EGR valve is coupled to the engine intake via an electronic valve regulator (EVR), said method comprising:

providing a variable duty cycle signal to the EVR in accordance with engine operating parameters when the engine has sufficient vacuum in the engine intake to operate the EGR valve; and providing a 100% duty cycle signal to the EVR in response to an indication that the engine will soon encounter a condition with insufficient vacuum in the engine intake to operate the EGR valve.

14. The method of claim 13 wherein said 100% duty cycle opens the EVR fully to allow maximum vacuum to be applied to said EGR diaphragm.

15. The method of claim 13 wherein sufficient vacuum comprises between 3 and 6 inches of Hg, said vacuum being between the engine intake and barometric pressure.

16. The method of claim 13 wherein said indication is based on a signal from an accelerator pedal position sensor, said accelerator pedal position sensor and said engine being disposed in a vehicle.

17. The method of claim 13 wherein said indication is based on a signal from an absolute pressure sensor disposed in the engine intake.

18. The method of claim 13 wherein said indication is based on throttle position, said throttle being disposed in the engine intake, the position of said throttle controlling intake flow into the engine.

19. The method of claim 13 wherein said indication is based on an operator demanded torque as determined in an electronic control unit coupled to the engine.

20. The method of claim 19 wherein said electronic control unit is coupled to a throttle position sensor coupled to a throttle disposed in the engine intake and a pressure sensor coupled to an engine intake.

* * * * *